US006565991B1

(12) United States Patent
Mehmood

(10) Patent No.: US 6,565,991 B1
(45) **Date of Patent: *May 20, 2003**

(54) COMPOSITE DOCTOR BLADE AND ITS METHOD OF MANUFACTURE

(75) Inventor: Bilal Mehmood, Sutton, MA (US)

(73) Assignee: Kadant Web Systems, Inc., Auburn, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/145,350

(22) Filed: May 14, 2002

Related U.S. Application Data

(63) Continuation-in-part of application No. 09/697,693, filed on Oct. 26, 2000, now Pat. No. 6,423,427.

(51) Int. Cl.[7] ..... B32B 15/18; C21D 9/00

(52) U.S. Cl. ..... 428/682; 76/101.1; 118/100; 118/261; 148/524; 148/529; 148/622; 148/659; 148/662; 148/663; 162/281; 399/274; 428/615; 428/683; 428/686; 428/908.8; 428/925

(58) Field of Search ..... 428/682, 615, 428/683, 686, 908.8, 925; 76/101.1; 118/100, 261; 148/529, 524, 622, 659, 662, 663; 162/281; 399/274

(56) References Cited

U.S. PATENT DOCUMENTS 4,144,777 A * 3/1979 Nystrom et al. ..... 76/112
4,462,293 A * 7/1984 Gunzner ..... 83/855
4,469,434 A * 9/1984 Yamazaki et al. ..... 399/351
4,812,878 A * 3/1989 Kaieda ..... 399/351
4,949,599 A * 8/1990 Iseli ..... 76/101.1
5,015,539 A * 5/1991 Daxelmueller et al. ..... 428/683
5,265,500 A * 11/1993 Gunzner et al. ..... 76/112
5,417,777 A * 5/1995 Henderer ..... 428/683
5,753,076 A * 5/1998 Costello et al. ..... 162/280
5,823,082 A * 10/1998 Wilson et al. ..... 83/152
5,863,329 A * 1/1999 Yamanouchi ..... 118/100
6,423,427 B1 * 7/2002 Mehmood ..... 428/682

FOREIGN PATENT DOCUMENTS

EP 0897792 A2 * 2/1999 ..... B31F/1/14

* cited by examiner

*Primary Examiner*—Robert R. Koehler
(74) *Attorney, Agent, or Firm*—Samuels, Gauthier, & Stevens, LLP

(57) ABSTRACT

A composite doctor blade comprises a steel support band configured with a width and thickness suitable for mounting in a blade holder, with tensile and yield strengths suitable for a selected doctoring application. A wear resistant strip of high speed steel is integrally joined to an edge of the support band. The wear resistant strip has tensile and yield strengths higher than those of the support band, and has a hardness of between about 55 to 75 Rc.

13 Claims, 2 Drawing Sheets

COMPOSITE DOCTOR BLADE AND ITS METHOD OF MANUFACTURE

This is a Continuation-In-Part of Ser. No. 09/697,693 filed on Oct. 26, 2000, and now U.S. Pat. No. 6,423,427.

BACKGROUND OF THE INVENTION

1. Field of the Invention

This invention relates to doctor blades used in various applications, including cleaning, creping and coating in paper making, tissue making, web converting, and similar operations.

2. Description of the Prior Art

Doctor blades contact the surfaces of rolls in paper making, tissue making and web converting machines for the purpose of cleaning, applying coatings to sheets, or sheet removal. Conventional doctor blade materials include metals, homogeneous plastics, and composite laminates made of synthetic and natural fibers.

Conventional doctor blades typically have a monolithic edge to edge structure. Selection of blade material therefore entails striking a compromise between materials which provide adequate resistance to edge wear, and materials having the tensile and yield strengths necessary to operate effectively in the intended doctoring mode. Often, this necessity to compromise results in the selection of a blade material with less than optimum resistance to edge wear.

There are numerous doctoring processes where blade edge wear can be particularly problematic. For example, in creping and coating, the quality of the resulting paper product is directly affected by the geometry of the blade edge. As the blade wears and the geometry changes, product characteristics such as bulk, tensile strength, softness or crepe count are adversely affected.

In cleaning operation, blade loading is directly related to the contact area of the blade edge. As the blade wears, its contact area increases with a concomitant reduction in contact pressure. Lower contact pressures can reduce cleaning effectiveness, which in turn can produce holes in the sheet, sheet breaks and/or sheet wraps.

In the past, those skilled in the art have sought to avoid or at least minimize the above problems by resorting to more frequent blade changes. However, this too is disadvantageous in that it reduces the overall efficiency of the paper making process.

Other attempts at extending blade life have included hardening blade surfaces by means of an ion nitriding process, as described in U.S. Pat. No. 5,753,076 (King et al.), or employing ceramic wear strips as disclosed in U.S. Pat. No. 5,863,329 (Yamanouchi). A number of drawbacks are associated with ion nitriding processes, including inter alia, high capital investments for costly vacuum chambers, batch processing of individual blades as opposed to the more economical processing of long lengths of coiled blade stock, and the uncontrolled application of the process to all blade surfaces rather than to only the edge regions which are susceptible to wear, which further increases costs.

Although ceramic wear strips beneficially extend blade life, their extreme hardness can produce excessive wear of certain roll surfaces, in particular the cast iron surfaces of yankee rolls. This in turn necessitates frequent and costly roll regrinding. Ceramic tipped blades penetrate much deeper into roll coatings, making it necessary to reduce blade loading pressures by as much as 30%. In creping operations, this reduced loading can have a detrimental effect on tissue properties. Ceramic materials are also expensive and as such, add significantly and disadvantageously to high blade costs.

SUMMARY OF THE INVENTION

The principal objective of the present invention is the provision of an improved doctor blade which has greater resistance to edge wear, thus providing a more consistent blade geometry, which in turn improves the quality and consistency of the paper products being produced. Greater resistance to blade wear also increases the overall efficiency of the paper making process by reducing the frequency of blade changing.

A doctor blade in accordance with the present invention has a steel support band configured with a width and thickness suitable for mounting in a blade holder, with tensile and yield strengths suitable for the intended doctoring application. A wear resistant strip of high-speed steel is integrally joined to an edge of the support band, preferably by electron beam welding. The wear resistant strip has tensile and yield strengths higher than those of the support band, with a hardness of between about 55 to 75 Rc.

These and other features and advantages of the present invention will now be described in greater detail with reference to the accompanying drawings, wherein:

DETAILED DESCRIPTION OF PREFERRED EMBODIMENTS

Figure 1:
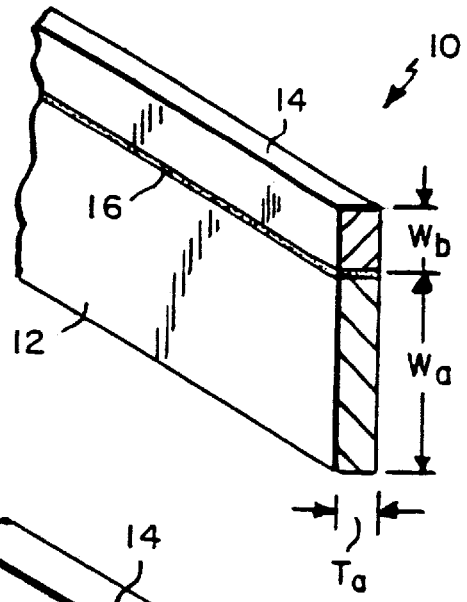
FIG. 1 is a perspective view of one embodiment of a doctor blade in accordance with the present invention.

With reference initially to FIG. 1, a composite doctor blade in accordance with the present invention is generally depicted at 10 as comprising a steel support band 12 having a width $W_a$ and thickness $T_a$ suitable for mounting in a conventional blade holder (not shown). The support band 12 has tensile and yield strengths suitable for the intended doctoring application, and may for example be selected from the group consisting of D6A, 6150, 6135, 1095, 1075, 304SS and 420SS.

A wear resistant strip 14 of high-speed steel ("HSS") is integrally joined as at 16 to an edge of the support band 12. The strip 14 has tensile and yield strengths higher than those of the support band 12, with a hardness of between about 55 to 75 Rc. Such materials advantageously resist plastic deformation and wear under the elevated temperature conditions frequently encountered in doctoring applications.

Preferably, the support band 12 and wear resistant strip 14 are joined by electron welding. The wear resistant strip 14 has a width $W_b$ of between about 0.025 to 0.33 of the total blade width measured as $W_a+W_b$.

Figure 2:
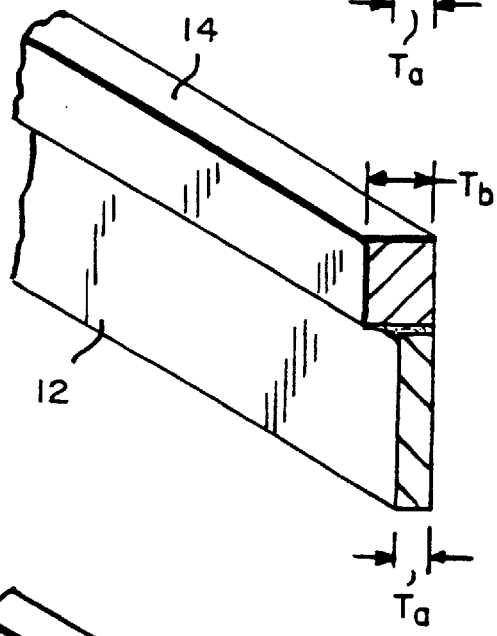
FIGS. 2 and 3 are perspective views similar to FIG. 1 showing other embodiments of doctor blades in accordance with the present invention.
Figure 3:
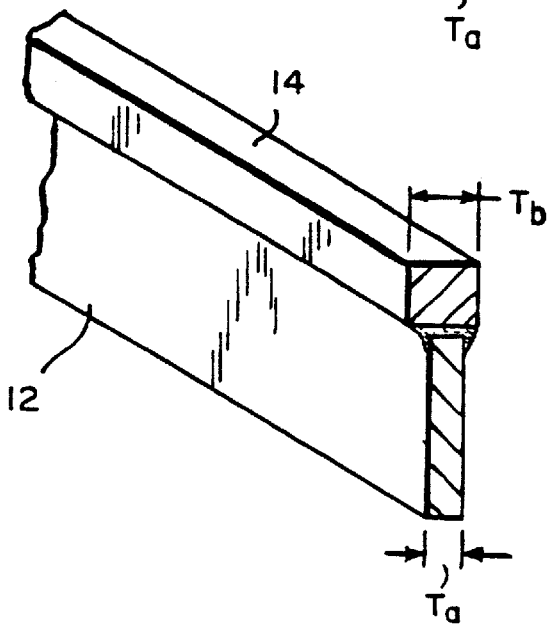

The wear resistant strip 14 and the support band 12 may have the same thickness $T_a$, as shown in FIG. 1. Alternatively, as shown in FIGS. 2 and 3, the wear resistant strip 14 may have a thickness $T_b$ greater but preferably not more than twice the thickness $T_a$ of the support band. In FIG. 2, the thicker wear resistant strip is offset with respect to the support band to provide a flat continuous surface on one side, and a stepped configuration in the opposite side. In FIG. 3, the wear resistant strip is centrally located, thus providing stepped configurations on both sides of the blade.

The material of the wear resistant strip is preferably selected from the group consisting of molybdenum high-speed steels, tungsten high speed steels and intermediate high-speed steels, all as specified in ASM Metals Handbook: Properties and Selection: Irons, Steels, and High Performance Alloys. Vol. 1 Tenth Edition. Copyright MARCH 1990 ASM INTERNATIONAL. The wear resistant strip 14 is preferably substantially free from carbide segregation, and with well dispersed spheriodal carbides having a size ranging from about 3 to 6, and preferably from about 5 to 6 units of measurement based on ASTM sizing charts.

Figure 4:
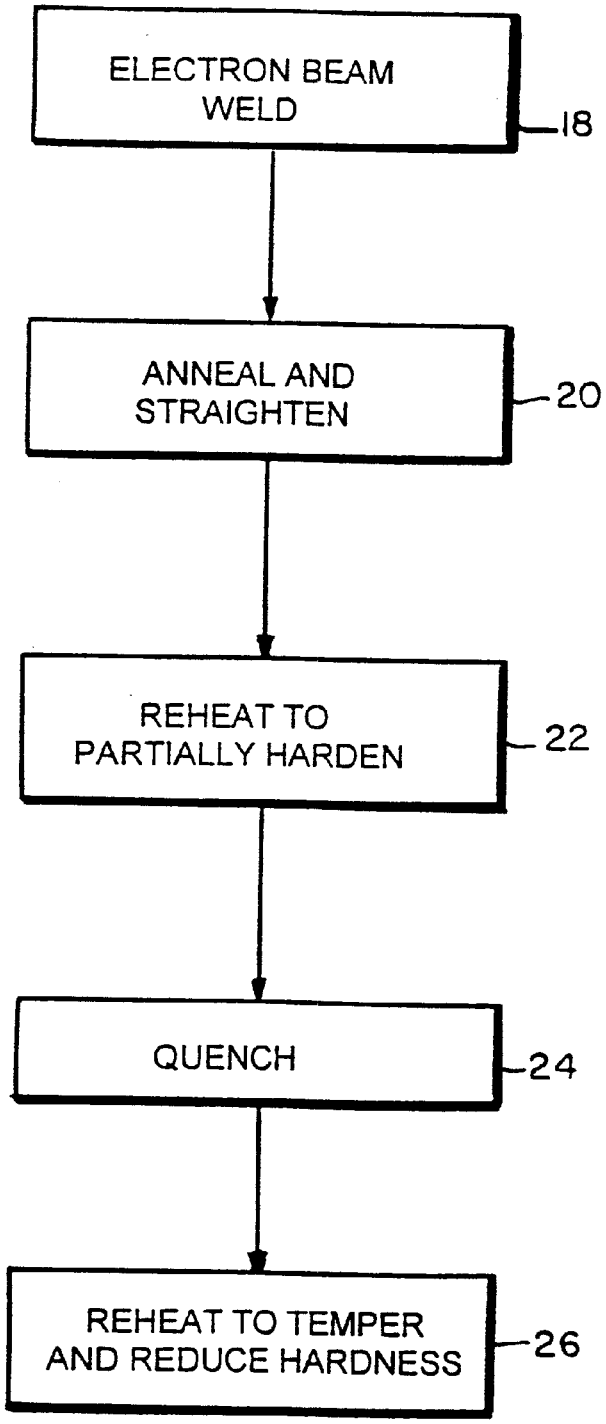
FIG. 4 is a block diagram depicting the method of manufacturing doctor blades in accordance with the present invention.

With reference to FIG. 4, a preferred method of manufacturing doctor blades in accordance with the present invention is shown as comprising the following steps, in sequence:

a) in block 18, electron beam welding the wear resistant strip 14 to the support band 12 to provide the composite blade structure;

b) in block 20, heating the composite blade structure 10 to a first temperature of preferably between about 1300 to 1450° F., to anneal and straighten the welded components;

c) in block 22, reheating the composite structure to a second temperature of between about 1500–2200° F. to partially harden the wear resistant strip 14;

d) in block 24, quenching the composite structure; and e) in block 26, reheating the composite structure to a third temperature of about 850–1200° F. to temper and reduce the hardness of the wear resistant strip to a level within the range of between about 55 to 75 Rc.

In contrast to the usage of fully hardened high speed steels in other industrial applications, partial hardening in accordance with the present invention achieves lower hardness levels which are more compatible with roll surfaces, while still providing marked improvement in wear resistance, making it possible in most instances to at least double useful blade life. By varying the thickness of the wear resistant strip while allowing the thickness of the support band to remain constant, fine tuning of paper properties can be achieved without the necessity of having to change blade holders. The composite blade stock of the present invention may be produced continuously and economically in long coiled lengths, thus providing significant cost savings as compared to prior art batch processes.

I claim:

1. A composite doctor blade comprising:

a steel support band configured with a width and thickness suitable for mounting in a blade holder, and having tensile and yield strengths suitable for a selected doctoring application; and a wear resistant strip of high speed steel integrally joined to an edge of said support band, said wear resistant strip having tensile and yield strengths higher than those of said support band, and having a hardness of between about 55 to 75 Rc.

2. The doctor blade of claim 1 wherein said wear resistant strip is joined to said support band by electron beam welding.

3. The doctor blade of claim 1 wherein said wear resistant strip has a width of between about 0.025 to 0.33 of the total blade width.

4. The doctor blade of claim 1 wherein the thickness of said wear resistant strip is greater than the thickness of said support band.

5. The doctor blade of claim 4 wherein the thickness of said wear resistant strip is not more than twice the thickness of said support band.

6. The doctor blade as claimed in claim 1 wherein the material of said wear resistant strip is selected from the group consisting molybdenum high-speed steels, tungsten high-speed steels and intermediate high-speed steels.

7. The doctor blade of claim 1 wherein said wear resistant strip is substantially free from carbide segregation and has well dispersed spheroidal carbides.

8. The doctor blade of claim 7 wherein said wear resistant strip has well dispersed spheroidal carbides having a size ranging from about 3 to 6 units of measurement based on ASTM sizing charts.

9. The doctor blade of claim 8 wherein said spheroidal carbides have a size ranging from about 5 to 6 units of measurement based on ASTM sizing charts.

10. A method of manufacturing the composite doctor blade of claim 1, comprising:

a) electron beam welding said wear resistant strip to said support band to provide a composite structure;

b) heating said composite structure to a first temperature to anneal and straighten said composite structure;

c) reheating said composite structure to a second temperature followed by quenching to partially harden said wear resistant strip; and d) reheating said composite structure to a third temperature to temper and reduce the hardness of said wear resistant strip to about 55 to 75 Rc.

11. The method of claim 10 wherein said first temperature in step (b) is between about 1300 to 1450° F.

12. The method of claim 10 wherein said second temperature in step (c) is between about 1500–2200° F.

13. The method of claim 10 wherein said third temperature in step (d) is between about 850–1200° F.

* * * * *